US011270835B2

(12) United States Patent
Yang et al.

(10) Patent No.: US 11,270,835 B2
(45) Date of Patent: Mar. 8, 2022

(54) COIL COMPONENT

(71) Applicant: SAMSUNG ELECTRO-MECHANICS CO., LTD., Suwon-si (KR)

(72) Inventors: Ju Hwan Yang, Suwon-si (KR); Byung Soo Kang, Suwon-si (KR); Byeong Cheol Moon, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 583 days.

(21) Appl. No.: 16/282,706

(22) Filed: Feb. 22, 2019

(65) Prior Publication Data

US 2020/0027647 A1 Jan. 23, 2020

(30) Foreign Application Priority Data

Jul. 20, 2018 (KR) ..... 10-2018-0084646

(51) Int. Cl.
*H01F 27/28* (2006.01)
*H01F 27/02* (2006.01)
(Continued)

(52) U.S. Cl.
CPC ..... *H01F 27/288* (2013.01); *H01F 27/02* (2013.01); *H01F 27/292* (2013.01); *H01F 27/346* (2013.01)

(58) Field of Classification Search
CPC ..... H01F 27/288; H01F 27/02; H01F 27/292; H01F 27/346
See application file for complete search history.

(56) References Cited

U.S. PATENT DOCUMENTS 9,871,005 B2 * 1/2018 Lin ..... H01L 23/552
2014/0009254 A1 * 1/2014 Ohkubo ..... H01F 27/022 336/192
(Continued)

FOREIGN PATENT DOCUMENTS

CN 105702428 A 6/2016
CN 108183017 A 6/2018
(Continued)

OTHER PUBLICATIONS

Office Action issued in Korean Patent Application No. 10-2018-0084646 dated Sep. 4, 2019, with English translation.
(Continued)

*Primary Examiner* — Elvin G Enad
*Assistant Examiner* — Malcolm Barnes
(74) *Attorney, Agent, or Firm* — Morgan, Lewis & Bockius LLP

(57) ABSTRACT

A coil component includes a body having a bottom surface and a top surface opposing each other in one direction, and a plurality of walls each connecting the bottom surface to the top surface of the body; a coil portion buried in the body, and having first and second lead-out portions; first and second external electrodes disposed on the bottom surface of the body and spaced apart from each other; via electrodes penetrating through the body and connecting the first and second lead-out portions and the first and second external electrodes to each other; a third external electrode including a pad portion disposed on the bottom surface of the body, and a connection portion extending to portions of the plurality of walls of the body, and spaced apart from the first and second external electrodes; a shielding layer including a cap portion disposed on the other surface of the body, and side wall portions respectively disposed on the plurality of walls of the body, and connected to the third external
(Continued)

electrode; and an insulating layer disposed between the shielding layer and the body, and between the first to third external electrodes and the body.

14 Claims, 12 Drawing Sheets

(51) Int. Cl.
*H01F 27/29* (2006.01)
*H01F 27/34* (2006.01)

(56) References Cited

U.S. PATENT DOCUMENTS

2015/0048915 A1* 2/2015 Yoon ..... H01F 17/0013 336/192
2016/0172103 A1 6/2016 Jeong et al.
2016/0189863 A1* 6/2016 Park ..... H01F 17/04 29/602.1
2016/0240296 A1* 8/2016 Kim ..... H01F 17/04
2017/0110240 A1* 4/2017 Masuda ..... H01F 17/0013
2017/0256353 A1* 9/2017 Park ..... B22F 3/02
2017/0338031 A1* 11/2017 Miyahara ..... H01G 4/232
2018/0166211 A1* 6/2018 Takatsuji ..... H02M 3/156
2018/0315545 A1* 11/2018 Kusumoto ..... H01F 27/36
2019/0199310 A1* 6/2019 Sato ..... H01F 17/0013
2019/0318868 A1* 10/2019 Chung ..... H05K 9/0018

FOREIGN PATENT DOCUMENTS

JP 2005-310863 A 4/2004
JP 2017-076796 A 4/2017
JP 2018-19059 A 2/2018
JP 2018-98270 A 6/2018
KR 10-2014-0005088 A 1/2014
KR 10-2015-0019730 A 2/2015
KR 10-2015-0089278 A 8/2015
KR 10-2016-0031391 A 3/2016

OTHER PUBLICATIONS

Office Action issued in corresponding Chinese Patent Application No. 201910326240.3 dated Dec. 21, 2020, with English translation.

* cited by examiner

COIL COMPONENT

CROSS-REFERENCE TO RELATED APPLICATION(S)

This application claims the benefit of priority to Korean Patent Application No. 10-2018-0084646 filed on Jul. 20, 2018 in the Korean Intellectual Property Office, the disclosure of which is incorporated herein by reference in its entirety.

1. TECHNICAL FIELD

The present disclosure relates to a coil component.

2. BACKGROUND

An inductor, a coil component, is a representative passive electronic component used together with a resistor and a capacitor in electronic devices.

As electronic devices are designed to have higher performance and to be reduced in size, electronic components used in electronic devices have been increased in number and reduced in size.

Accordingly, there has been increasing demand for removing a factor causing noise such as electromagnetic interference (EMI) in electronic components.

A currently used EMI shielding technique is, after mounting electronic components on a substrate, to envelop the electronic components and the substrate with a shielding can.

SUMMARY

An aspect of the present disclosure is to provide a coil component capable of reducing magnetic flux leakage.

Another aspect of the present disclosure is to provide a coil component having a reduced size and thickness while reducing magnetic flux leakage.

According to an aspect of the present disclosure, a coil component includes a body having one surface and the other surface opposing each other in one direction, and a plurality of walls each connecting one surface to the other surface of the body; a coil portion buried in the body, and having first and second lead-out portions; first and second external electrodes disposed on one surface of the body and spaced apart from each other; via electrodes penetrating through the body and connecting the first and second lead-out portions and the first and second external electrodes to each other; a third external electrode including a pad portion disposed on one surface of the body, and a connection portion extending to portions of the plurality of walls of the body, and spaced apart from the first and second external electrodes; a shielding layer including a cap portion disposed on the other surface of the body, and side wall portions respectively disposed on the plurality of walls of the body, and connected to the third external electrode; and an insulating layer disposed between the shielding layer and the body, and between the first to third external electrodes and the body.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
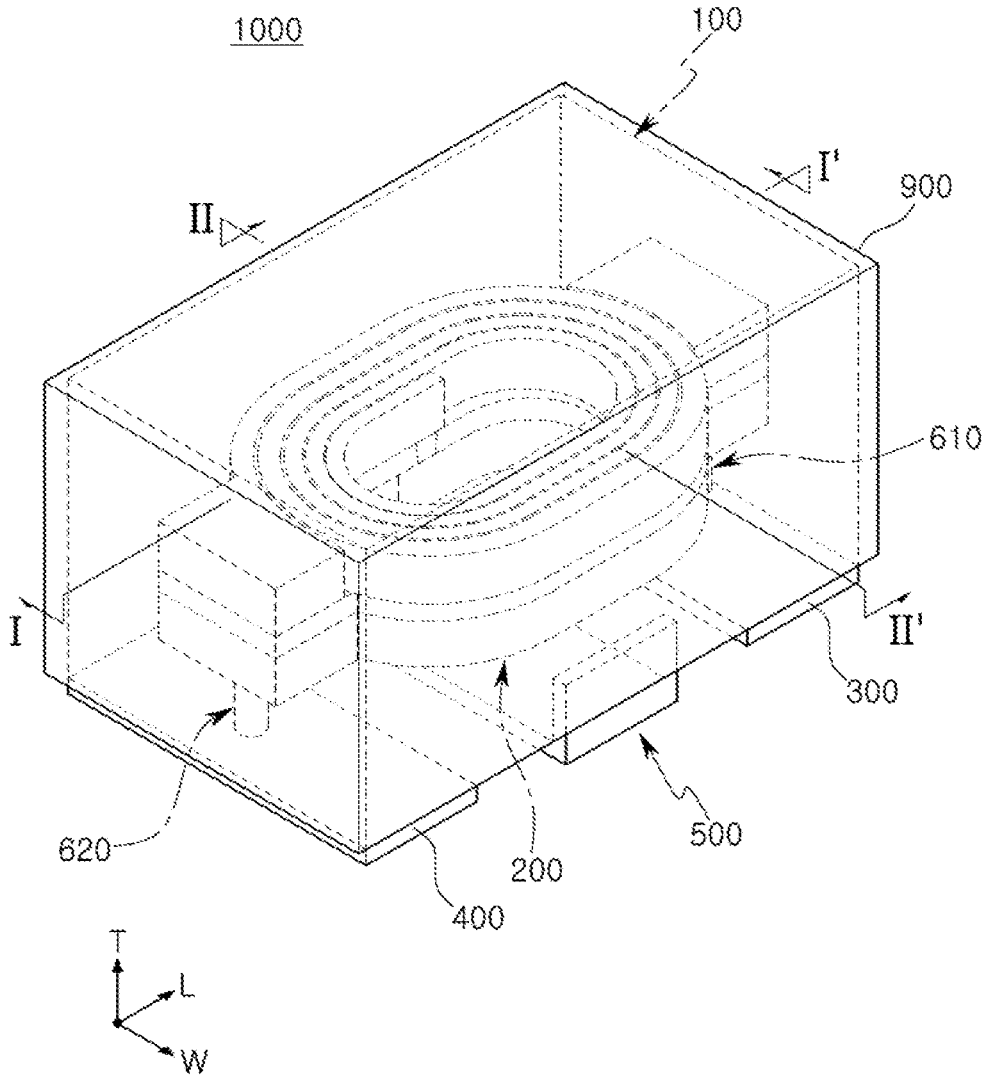
FIG. 1 is a schematic diagram illustrating a coil component according to an exemplary embodiment in the present disclosure.

Hereinafter, embodiments of the present disclosure will be described as follows with reference to the attached drawings.

The terms used in the exemplary embodiments are used to simply describe an exemplary embodiment, and are not intended to limit the present disclosure. A singular term includes a plural form unless otherwise indicated. The terms used in the exemplary embodiments are used to simply describe an exemplary embodiment, and are not intended to limit the present disclosure. A singular term includes a plural form unless otherwise indicated. The terms, "include," "comprise," "is configured to," etc. of the description are used to indicate the presence of features, numbers, steps, operations, elements, parts or combination thereof, and do not exclude the possibilities of combination or addition of one or more features, numbers, steps, operations, elements, parts or combination thereof. Also, the term "disposed on," "positioned on," and the like, may indicate that an element is positioned on or beneath an object, and does not necessarily mean that the element is positioned on the object with reference to a gravity direction.

The term "coupled to," "combined to," and the like, may not only indicate that elements are directly and physically in contact with each other, but also include the configuration in which the other element is interposed between the elements such that the elements are also in contact with the other component.

Sizes and thicknesses of elements illustrated in the drawings are indicated as examples for ease of description, and exemplary embodiments in the present disclosure are not limited thereto.

In the drawings, an L direction is a first direction or a length direction, a W direction is a second direction or a width direction, a T direction is a third direction or a thickness direction.

In the descriptions described with reference to the accompanied drawings, the same elements or elements corresponding to each other will be described using the same reference numerals, and overlapped descriptions will not be repeated.

In electronic devices, various types of electronic components may be used, and various types of coil components may be used between the electronic components to remove noise, or for other purposes.

In other words, in electronic devices, a coil component may be used as a power inductor, a high frequency inductor, a general bead, a high frequency bead, a common mode filter, and the like.

First Embodiment

Figure 2:
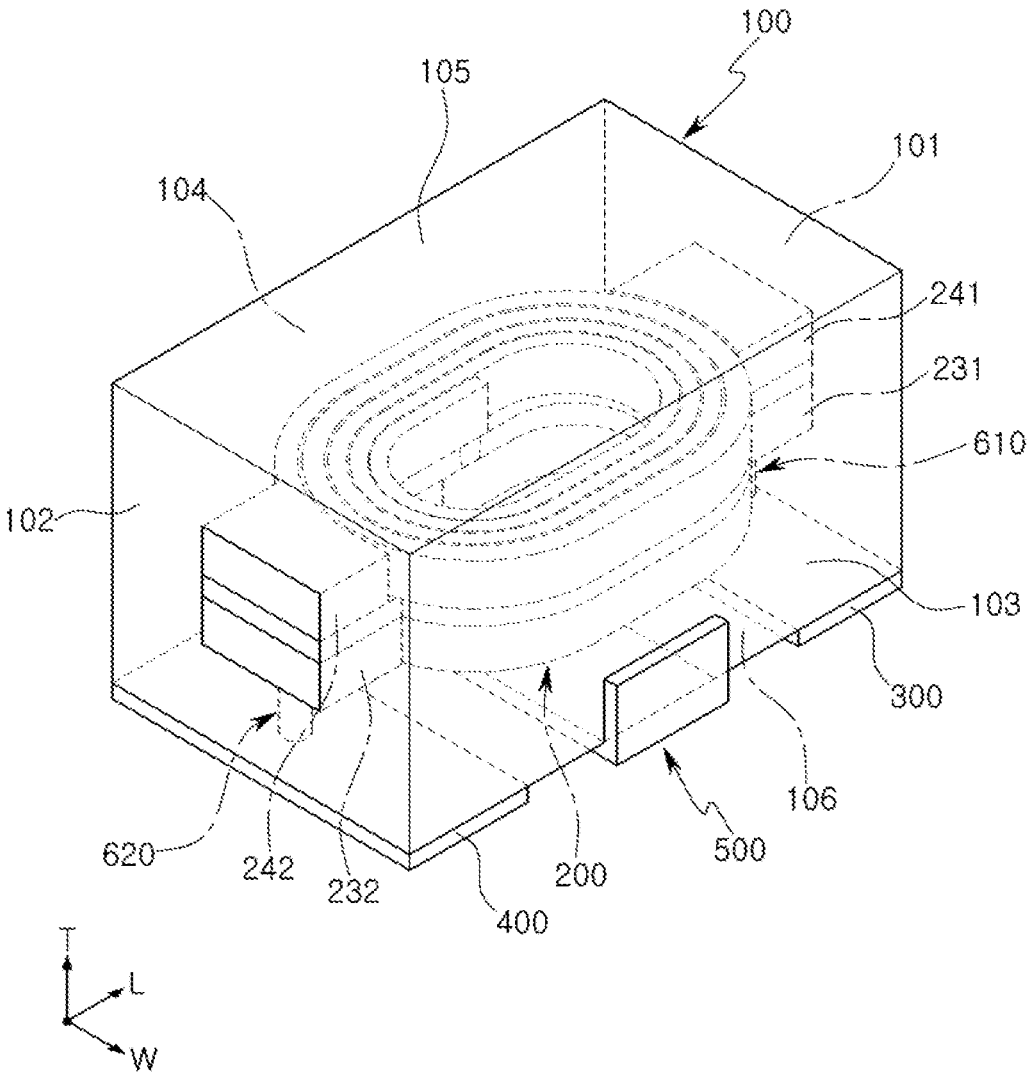
FIG. 2 is a diagram illustrating a coil component in which some of elements illustrated in FIG. 1 are omitted.
Figure 3:
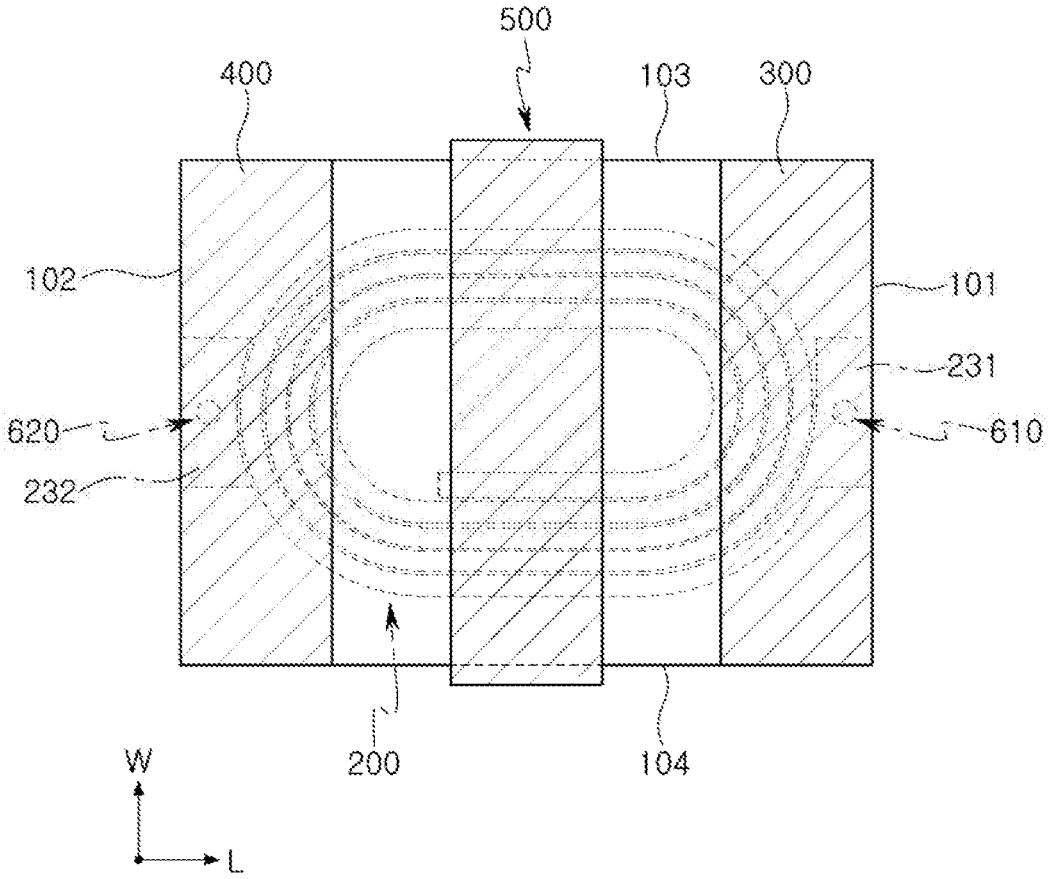
FIG. 3 is a diagram illustrating a coil component illustrated in FIG. 2, viewing from a lower portion direction.
Figure 4:
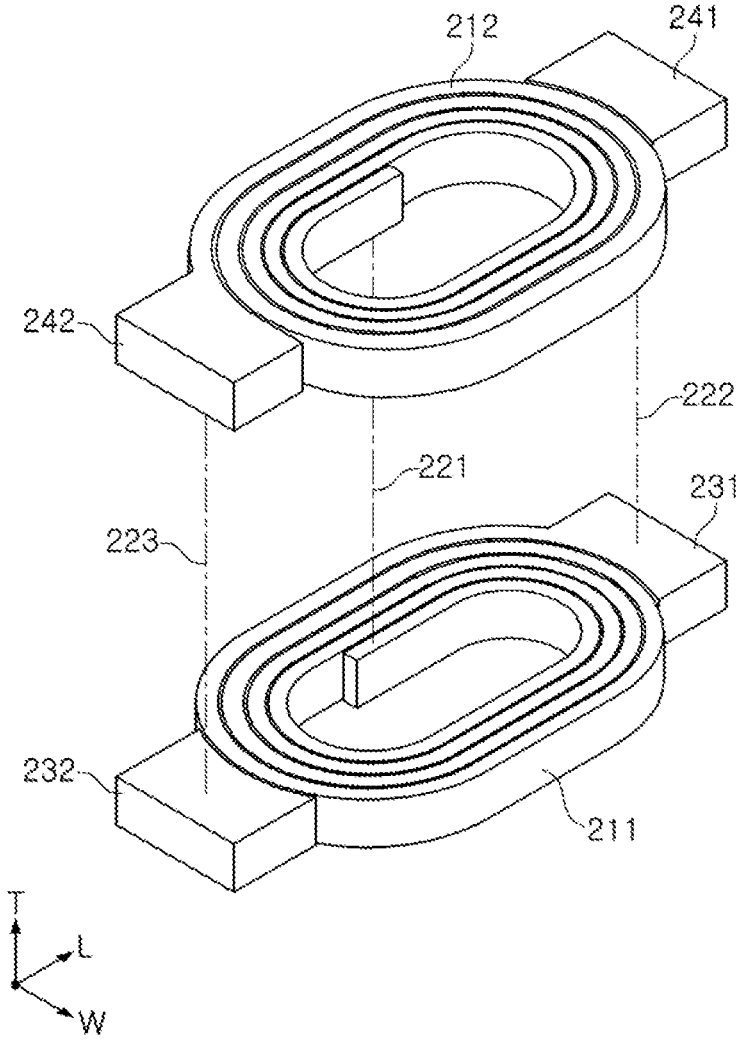
FIG. 4 is an exploded diagram illustrating a coil component.
Figure 5:
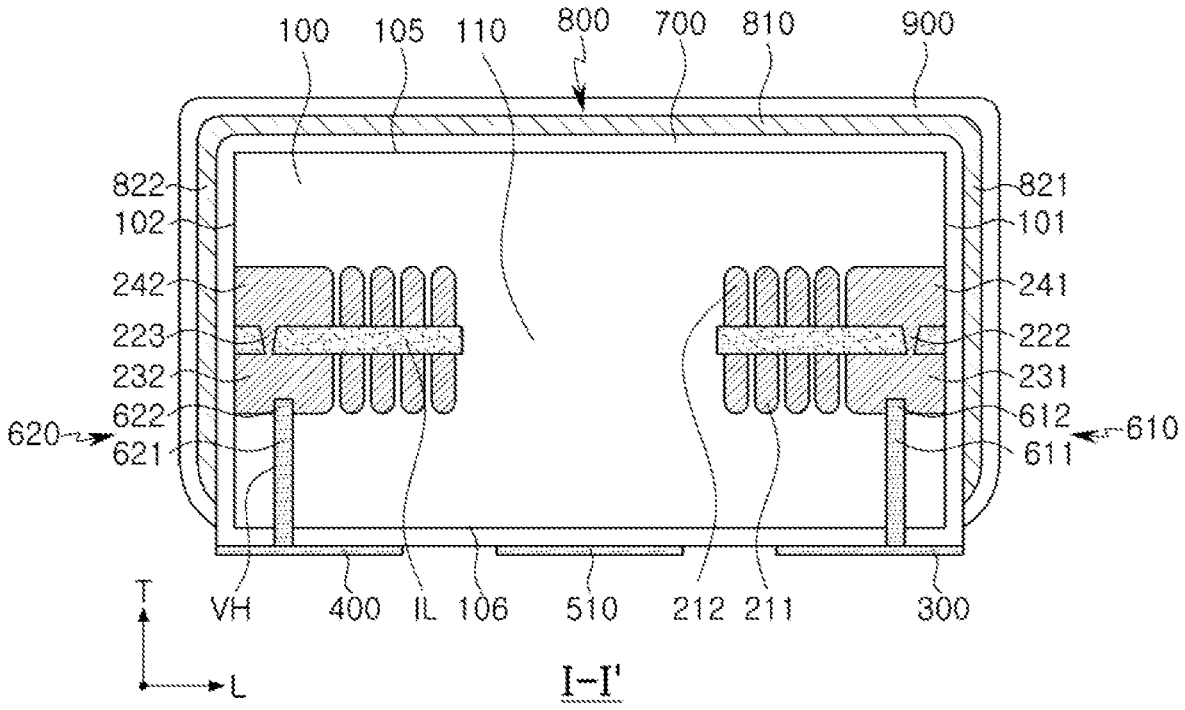
FIG. 5 is a cross-sectional diagram taken along line I-I' in FIG. 1.
Figure 6:
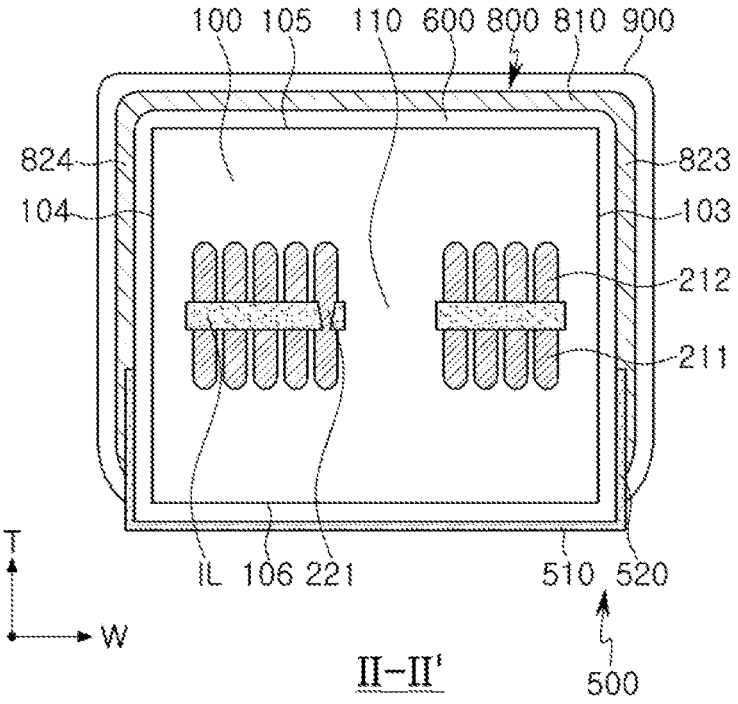
FIG. 6 is a cross-sectional diagram taken along line II-II' in FIG. 1.

FIG. 1 is a schematic diagram illustrating a coil component according to an exemplary embodiment. FIG. 2 is a diagram illustrating a coil component in which some of elements illustrated in FIG. 1 are omitted. FIG. 3 is a diagram illustrating a coil component illustrated in FIG. 2, viewing from a lower portion direction. FIG. 4 is an exploded diagram illustrating a coil component. FIG. 5 is a cross-sectional diagram taken along line I-I' in FIG. 1. FIG. 6 is a cross-sectional diagram taken along line II-II' in FIG. 1. With regard to FIG. 2, FIG. 2 illustrates a coil component illustrated in FIG. 1, where a shielding layer and a cover layer are omitted.

Referring to FIGS. 1 to 6, a coil component 1000 according to an exemplary embodiment may include a body 100, an internal insulating layer IL, a coil portion 200, first to third external electrodes 300, 400, and 500, first and second via electrodes 610 and 620, an insulating layer 700, and a shielding layer 800, and may further include a cover layer 900.

The body 100 may form an exterior of the coil component 1000, and may bury the coil portion 200 in the body 100.

The body 100 may have a hexahedral shape.

Referring to FIGS. 1 to 2, the body 100 may include a first surface 101 and a second surface 102 opposing each other in a length direction L, a third surface 103 and a fourth surface 104 opposing each other in a width direction W, and a fifth surface 105 (a top surface) and a sixth surface 106 (a bottom surface) opposing each other in a thickness direction T. The first to fourth surfaces 101, 102, 103, and 104 of the body 100 may be walls of the body 100 connecting the fifth surface 105 and the sixth surface 106 of the body 100. In the description below, "both front and rear surfaces of the body" may refer to the first surface 101 and the second surface 102, and "both side surfaces of the body" may refer to the third surface 103 and the fourth surface 104 of the body.

As an example, the body 100 may be configured such that the coil component 1000 in which the external electrodes 300 and 400 are formed may have a length of 2.0 mm, a width of 1.2 mm, and a thickness of 0.65 mm, but an exemplary embodiment of the coil component 1000 is not limited thereto. In one embodiment, the length of the coil component 1000 is 1.9 mm, 1.8 mm, 1.7 mm, 1.6 mm, or 1.5 mm. In one embodiment, the width of the coil component 1000 is 1.1 mm, 1.0 mm, 0.9 mm, 0.0 mm, 0.7 mm, or 0.6 mm. In one embodiment, the thickness of the coil component is 0.60 mm, 0.55 mm, 0.50 mm, 0.45 mm, 0.40 mm, 0.35 mm, or 0.30 mm.

The body 100 may include a magnetic material and a resin material. For example, the body 100 may be formed by layering one or more magnetic composite sheets including a magnetic material dispersed in a resin. Alternatively, the body 100 may have a structure different from the structure in which a magnetic material is dispersed in a resin. For example, the body 100 may be formed of a magnetic material such as a ferrite.

The magnetic material may be a ferrite or a magnetic metal powder.

The ferrite may include, for example, one or more materials among a spinel ferrite such as an Mg—Zn ferrite, an Mn—Zn ferrite, an Mn—Mg ferrite, a Cu—Zn ferrite, an Mg—Mn—Sr ferrite, an Ni—Zn ferrite, and the like, a hexagonal ferrite such as a Ba—Zn ferrite, a Ba—Mg ferrite, a Ba—Ni ferrite, a Ba—Co ferrite, a Ba—Ni—Co ferrite, and the like, a garnet ferrite such as an yttrium (Y) ferrite, and a lithium (Li) ferrite.

The magnetic metal powder may include one or more selected from a group consisting of iron (Fe), silicon (Si), chromium (Cr), cobalt (Co), molybdenum (Mo), aluminum (Al), niobium (Nb), copper (Cu), and nickel (Ni). For example, the magnetic metal powder may be one or more among a pure iron powder, a Fe—Si alloy powder, a Fe—Si—Al alloy powder, a Fe—Ni alloy powder, a Fe—Ni—Mo alloy powder, Fe—Ni—Mo—Cu alloy powder, a Fe—Co alloy powder, a Fe—Ni—Co alloy powder, a Fe—Cr alloy powder, a Fe—Cr—Si alloy powder, a Fe—Si—Cu—Nb alloy powder, a Fe—Ni—Cr alloy powder, and a Fe—Cr—Al alloy powder.

The magnetic metal powder may be amorphous or crystalline. For example, the magnetic metal powder may be a Fe—Si—B—Cr amorphous alloy powder, but an exemplary embodiment of the magnetic metal powder is not limited thereto.

The ferrite and the magnetic metal powder may have an average diameter of 0.1 μm to 30 μm, but an example of the average diameter is not limited thereto. In one embodiment, the average diameter of the ferrite or the magnetic metal powder is 0.5 μm, 1 μm, 5 μm, 10 μm, 15 μm, 20 μm, or 25 μm.

The body 100 may include two or more types of magnetic materials dispersed in a resin. The notion that types of the magnetic materials are different may indicate that one of an average diameter, a composition, crystallinity, and a form of one of magnetic materials is different from those of the other magnetic material.

The resin may include one of an epoxy resin, a polyimide, a liquid crystal polymer, or mixture thereof, but the example of the resin is not limited thereto.

The body 100 may include a core 110 penetrating through the coil portion 200. The core 110 may be formed by filling a through hole of the coil portion 200 with a magnetic composite sheet, but an exemplary embodiment thereof is not limited thereto.

The internal insulating layer IL may be buried in the body 100. The internal insulating layer IL may support the coil portion 200.

The internal insulating layer IL may be formed of an insulating material including a thermosetting insulating resin such as an epoxy resin, a thermoplastic insulating resin such as a polyimide, or a photosensitive insulating resin, or may be formed of an insulating material in which a reinforcing material such as a glass fiber or an inorganic filler is impregnated with such an insulating resin. For example, the internal insulating layer IL may be formed of an insulating material such as prepreg, Ajinomoto Build-up Film (ABF), FR-4, a bismaleimide triazine (BT) resin, a photoimageable dielectric (PID), and the like, but an example of the material of the internal insulating layer is not limited thereto.

As an inorganic filler, one or more materials selected from a group consisting of silica ($SiO_2$), alumina ($Al_2O_3$), silicon carbide (SiC), barium sulfate ($BaSO_4$), talc, mud, a mica powder, aluminium hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the internal insulating layer IL is formed of an insulating material including a reinforcing material, the internal insulating layer IL may provide improved stiffness. When the internal insulating layer IL is formed of an insulating material which does not include a glass fiber, the internal insulating layer IL may be desirable to reducing an overall thickness of the coil portion 200. When the internal insulating layer IL is formed of an insulating material including a photosensitive insulating resin, the number of processes for forming the coil portion 200 may be reduced such that manufacturing costs may be reduced, and a fine via may be formed.

The coil portion 200 may be buried in the body 100, and may embody properties of the coil component. For example, when the coil component 1000 is used as a power inductor, the coil portion 200 may store an electric field as a magnetic field such that an output voltage may be maintained, thereby stabilizing power of an electronic device.

The coil portion 200 may include first and second coil patterns 211 and 212, first and second lead-out portions 231 and 232, first and second auxiliary lead-out portions 241 and 242, and first to third vias 221, 222, and 223.

For example, referring to FIGS. 5 and 6, the first coil pattern 211, the first lead-out portion 231, and the second lead-out portion 232 may be disposed on a lower surface of the internal insulating layer IL opposing the sixth surface 106 of the body 100, and the second coil pattern 212, the first auxiliary lead-out portion 241, and the second auxiliary lead-out portion 242 may be disposed on an upper surface of the internal insulating layer IL opposing a lower surface of the internal insulating layer IL.

Referring to FIGS. 4 to 6, the first coil pattern 211 may be in contact with and connected to the first lead-out portion 231, and the first coil pattern 211 and the first lead-out portion 231 may be spaced apart from the second lead-out portion 232, on the lower surface of the internal insulating layer IL. Also, the second coil pattern 212 may be in contact with and connected to the second auxiliary lead-out portion 242, and the second coil pattern 212 and the second auxiliary lead-out portion 242 may be spaced apart from the first auxiliary lead-out portion 241, on the upper surface of the internal insulating layer IL. Also, the first via 221 may penetrate through the internal insulating layer IL and may be in contact with the first coil pattern 211 and the second coil pattern 212, the second via 222 may penetrate through the internal insulating layer IL and may be in contact with the first lead-out portion 231 and the first auxiliary lead-out portion 241, and the third via 223 may penetrate through the internal insulating layer IL and may be in contact with the second lead-out portion 232 and the second auxiliary lead-out portion 242. Accordingly, the coil portion 200 may function as a single coil.

The first coil pattern 211 and the second coil pattern 212 each may have a planar spiral shape forming at least one turn centered on the core 110 as an axis. For example, the first coil pattern 211 may form at least one turn on a lower surface of the internal insulating layer IL centered on the core 110 as an axis.

The first and second lead-out portions 231 and 232 and the first and second auxiliary lead-out portions 241 and 242 may respectively be exposed to both front and rear surfaces 101 and 102 of the body 100. In other words, the first lead-out portion 231 may be exposed to the first surface 101 of the body 100, and the second lead-out portion 232 may be exposed to the second surface 102 of the body 100. Also, the first auxiliary lead-out portion 241 may be exposed to the first surface 101 of the body 100, and the second auxiliary lead-out portion 242 may be exposed to the second surface 102 of the body 100.

At least one of the first and second coil patterns 211 and 212, the first to third vias 221, 222, and 223, the first and second lead-out portions 231 and 232, or the first and second auxiliary lead-out portions 241 and 242 may include at least one or more conductive layers.

For example, when the second coil pattern 212, the first and second auxiliary lead-out portions 241 and 242, and the first to third vias 221, 222, and 223 are formed on the other surface of the internal insulating layer IL through a plating process, the second coil pattern 212, the first and second auxiliary lead-out portions 241 and 242, and the first to third vias 221, 222, and 223 each may include seed layers such as an electroless plating layer, and the like, and an electroplating layer. The electroplating layer may have a single-layer structure, or may have a multilayer structure. The electroplating layer having a multilayer structure may have a conformal film structure in which one of the electroplating layers is covered by the other electroplating layer, or may have a form in which one of the electroplating layers is disposed on one surface of the other plating layers. The seed layer of the second coil pattern 212, the seed layers of the first and second auxiliary lead-out portions 241 and 242, and the seed layers of the first to third vias 221, 222, and 223 may be integrated with one another such that no boundary may be formed therebetween, but an exemplary embodiment thereof is not limited thereto. The electroplating layer of the second coil pattern 212, the electroplating layers of the first and second auxiliary lead-out portions 241 and 242, and the electroplating layers of the first to third vias 221, 222, and 223 may be integrated with one another such that no boundary may be formed therebetween, but an exemplary embodiment thereof is not limited thereto.

As another example, referring to FIGS. 1 to 6, when the first coil pattern 211 and the first and second lead-out portions 231 and 232 disposed on a lower surface of the internal insulating layer IL, and the second coil pattern 212 and the first and second auxiliary lead-out portions 241 and 242 disposed on an upper surface of the internal insulating layer IL are formed independently, and the coil portion 200 is formed by layering the first coil pattern 211, the first and second lead-out portions 231 and 232, the second coil pattern 212, and the first and second auxiliary lead-out portions 241 and 242 on the internal insulating layer IL, the first to third vias 221, 222, and 223 may include a metal layer having a high melting point, and a metal layer having a low melting point relatively lower than the melting point of the metal layer having a high melting point. The metal layer having a low melting point may be formed of a solder including lead (Pb) and/or tin (Sn). The metal layer having a low melting point may have at least a portion melted due to pressure and temperature generating during the layer process, and an inter-metallic compound layer (IMC layer)

may be formed on a boundary between the metal layer having a low melting point and the second coil pattern 212, for example.

Referring to FIGS. 5 and 6, the first and second coil patterns 211 and 212, the first and second lead-out portions 231 and 232, and the first and second auxiliary lead-out portions 241 and 242 may be formed on and protrude from a lower surface and an upper surface of the internal insulating layer IL. As another example, the first coil pattern 211 and the first and second lead-out portions 231 and 232 may be formed on and protrude from the lower surface of the internal insulating layer IL, and the second coil pattern 212 and the auxiliary lead-out portions 241 and 242 may be buried in the upper surface of the internal insulating layer IL, and the upper surfaces of the second coil pattern 212 and the first and second auxiliary lead-out portions 241 and 242 may be exposed to the upper surface of the internal insulating layer IL. In this case, concave portions may be formed on the upper surface of the second coil pattern 212 and/or the upper surfaces of the first and second auxiliary lead-out portions 241 and 242 such that the upper surface of the second coil pattern 212 and/or the upper surfaces of the first and second auxiliary lead-out portions 241 and 242 may not be coplanar with the upper surface of the internal insulating layer IL.

The first and second coil patterns 211 and 212, the first and second lead-out portions 231 and 232, the first and second auxiliary lead-out portions 241 and 242, and the first to third vias 221, 222, and 223 each may be formed of a conductive material such as aluminum (Al), silver (Ag), tin (Sn), gold (Au), nickel (Ni), lead (Pb), titanium (Ti), or alloys thereof, but an example of the material is not limited thereto.

Referring to FIG. 4, the first auxiliary lead-out portion 241 may be irrelevant to electrical connections between the other components, and the first auxiliary lead-out portion 241 may thus be omitted. However, it may be desirable to provide the first auxiliary lead-out portion 241 in order to omit the process for distinguishing the fifth surface 105 and the sixth surface 106 of the body 100 from each other.

The first and second external electrodes 300 and 400 may be disposed on the sixth surface 106 of the body 100 and spaced apart from each other.

The first and second external electrodes 300 and 400 may be formed of a single layer or multiple layers. For example, the first external electrode 300 may include a first layer including copper (Cu), a second layer disposed on the first layer and including nickel (Ni), and a third layer disposed on the second layer and including tin (Sn). The second external electrode 400 may include a first layer including copper (Cu), a second layer disposed on the first layer and including nickel (Ni), and a third layer disposed on the second layer and including tin (Sn).

The first and second via electrodes 610 and 620 may penetrate through the body 100 and may connect the first and second external electrodes 300 and 400 and the first and second lead-out portions 231 and 232, respectively. In other words, in the exemplary embodiment, the first and second external electrodes 300 and 400 and the first and second lead-out portions 231 and 232 may be connected to each other through the first and second via electrodes 610 and 620 disposed in the body 100, respectively, rather than connecting the first and second external electrodes 300 and 400 and the first and second lead-out portions 231 and 232 through a surface of the body 100. For example, the first via electrode 610 may connect the first external electrode 300 and the first lead-out portion 231 to each other, and the second via electrode 620 may connect the second external electrode 400 and the second lead-out portion 232 to each other.

The first and second via electrodes 610 and 620 may include first and second through-portions 611 and 621 penetrating through the body 100, respectively, and first and second extended portions 612 and 622 connected to first and second the through-portions 611 and 621 and respectively disposed in the first and second lead-out portions 231 and 232, respectively. In other words, the first via electrode 610 may include the first through-portion 611 penetrating through the body 100, and the first extended portion 612 extending into the first lead-out portion 231 from the first through-portion 611. The second via electrode 620 may include the second through-portion 621 penetrating through the body 100, and the second extended portion 622 extending into the second lead-out portion 232. Recesses may respectively be formed in the first and second lead-out portions 231 and 232 in which the first and second extended portions 612 and 622 are disposed. The recesses may be formed as via holes VH formed in the body 100 for forming the first and second via electrodes 610 and 620 extend into the first and second lead-out portions 231 and 232, respectively. In one embodiment, the coil component 1000 may include more than two via electrodes.

The first and second through-portions 611 and 621 and the first and second extended portions 612 and 622 may be formed in the same process such that no boundaries may be formed therebetween, but an exemplary embodiment is not limited thereto.

The first and second via electrodes 610 and 620 may be formed by processing the via holes VH in the body 100 by a drilling process and filling the via holes VH with a conductive material. As an example, the via electrodes 610 and 620 may be formed through an electroplating process. In the example above, the via electrodes 610 and 620 may further include seed layers disposed on internal walls of the via holes VH. As another example, the via electrodes 610 and 620 may be formed by filling the via holes VH with a conductive paste. The drilling process may refer to a mechanical drilling process using a drill bit, but also a laser drilling process using a laser.

The third external electrode 500 may be spaced apart from the first and second external electrodes 300 and 400, and may include a pad portion 510 disposed on the sixth surface 106 of the body 100, and a connection portion 520 extending portions of the first to fourth surfaces 101, 102, 103, and 104 of the body 100. As the connection portion 520 is in contact with a shielding layer 800 on a surface of the body 100, the third external electrode 500 may be connected to the shielding layer 800. The third external electrode 500 may not be electrically connected to the first and second external electrodes 300 and 400. In the exemplary embodiment, the connection portion 520 may extend onto the third and fourth surfaces 103 and 104 of the body 100 from the pad portion 510. As long as the connection portion 520 is connected to the pad portion 510 and the shielding layer 800 on a surface of the body 100 and is spaced apart from the first and second external electrodes 300 and 400, a position in which the connection portion 520 is disposed, a shape of the connection portion 520, and the like, may be configured differently.

The pad portion 510 and the connection portion 520 may be integrated with each other in the same process such that no boundary may be formed therebetween, but an exemplary embodiment thereof is not limited thereto.

When the coil component 1000 is mounted on a printed circuit board, the third external electrode 500 may be electrically connected to a ground layer of the printed circuit board. Thus, the third external electrode 500 may transfer electrical energy generating from the shielding layer 800 to a printed circuit board.

The first to third external electrodes 300, 400, and 500, and the first and second via electrodes 610 and 620 each may be formed of a conductive material such as copper (Cu), aluminum (Al), silver (Ag), tin (Sn), gold (Au), nickel (Ni), lead (Pb), chromium (Cr), titanium (Ti), or alloys thereof, but an example of the material is not limited thereto.

The first and second via electrodes 610 and 620 and the first and second external electrodes 300 and 400 may be formed in the same process such that no boundary may be formed therebetween, but an exemplary embodiment thereof is not limited thereto.

When the first to third external electrodes 300, 400, and 500, and the first and second via electrodes 610 and 620 are formed through an electroplating process, the first to third external electrodes 300, 400, and 500, and the first and second via electrodes 610 and 620 may further include seed layers. The seed layers may be formed through a vapor deposition process such as an electroless plating process, a sputtering process, or the like, and may include at least one of copper (Cu) and titanium (Ti). The seed layers may be formed as a single layer or multiple layers.

The shielding layer 800 may include a cap portion 810 disposed on the fifth surface 105 of the body 100, and side wall portions 821, 822, 823, and 824 respectively disposed on the first to fourth surfaces 101, 102, 103, and 104 of the body 100, and may be connected to the third external electrode 500. The shielding layer 800 may be disposed on a surface of the body 100 other than the sixth surface 106 of the body 100, and may reduce magnetic flux leakage of the coil component 1000. The side wall portions 821, 822, 823, and 824 of the shielding layer 800 may be in contact with the connection portion 520 of the third external electrode 500, and accordingly, the shielding layer 800 may be connected to the third external electrode 500. As an example, as illustrated in FIG. 6, while the connection portion 520 is disposed on each of the third and fourth surfaces 103 and 104 of the body 100, the third and fourth side wall portions 823 and 824 may be formed on the third and fourth surfaces 103 and 104 of the body 100, and accordingly, the shielding layer 800 may be connected to the third external electrode 500.

The cap portion 810 may be integrated with the side wall portions 821, 822, 823, and 824. In other words, the cap portion 810 and the side wall portions 821, 822, 823, and 824 may be formed in the same process such that no boundary may be formed therebetween. As an example, the cap portion 810 and the side wall portions 821, 822, 823, and 824 may be integrated with each other by forming the shielding layer 800 on the first to fifth surfaces of the body 100 through a vapor deposition process such as a sputtering process. When forming the shielding layer 800 through a sputtering process, ends of the side wall portions 821, 822, 823, and 824 may not be formed up to the sixth surface 106 of the body 100 due to a low step coverage of the sputtering process.

The shielding layer 800 may include at least one of a conductive material and a magnetic material. For example, the conductive material may be a metal or an alloy including one or more materials selected from a group consisting of copper (Cu), aluminum (Al), iron (Fe), silicon (Si), boron (B), chromium (Cr), niobium (Nb), nickel (Ni) or alloys thereof, or may be Fe—Si or Fe—Ni. The shielding layer 800 may also include one or more materials selected from a group consisting of a ferrite, a permalloy, and an amorphous ribbon.

The shielding layer 800 may include two or more separate fine structures. For example, when the cap portion 810 and the side wall portions 821, 822, 823, and 824 each are formed of an amorphous ribbon sheet divided into a plurality of pieces isolated from one another, the cap portion 810 and the side wall portions 821, 822, 823, and 824 each may include a plurality of fine structures isolated from one another.

The shielding layer 800 may have a thickness of 10 nm to 100 μm. When a thickness of the shielding layer 800 is smaller than 10 nm, no EMI shielding effect may be implemented, and when a thickness of the shielding layer 800 is greater than 100 μm, an overall length, width, and thickness of the coil component may increase such that it may be difficult to reduce a size of the coil component. In one embodiment, the thickness of the shielding layer 800 is 50 nm, 100 nm, 500 nm, 1 μm, or 50 μm.

The insulating layer 700 may be disposed between the shielding layer 800 and the body 100, and between the first to third external electrodes 300, 400, and 500 and the body 100. The insulating layer 700 may prevent electrical shorts between the shielding layer 800 and the body 100 and electrical shorts between the shielding layer 800 and the first and second external electrodes 300 and 400. The insulating layer 700 may be formed on the first to sixth surfaces 101, 102, 103, 104, 105, and 106 of the body 100 earlier than on the first to third external electrodes 300, 400, and 500 and the shielding layer 800. In other words, the first to third external electrodes 300, 400, and 500 and the shielding layer 800 may be formed on the insulating layer 700.

The insulating layer 700 may include at least one of a thermoplastic resin such as a polystyrene resin, a vinyl acetate resin, a polyester resin, a polyethylene resin, a polypropylene resin, a polyamide resin, a rubber resin, an acrylic resin, and the like, a thermosetting resin such as a phenolic resin, an epoxy resin, a urethane resin, a melamine resin, an alkyd resin, and the like, a photosensitive resin, a parylene, and silicon oxide (SiOx) or silicon nitride (SiNx).

The insulating layer 700 may be formed by applying a liquid insulating resin on the body 100, by layering an insulating film such as a dry film (DF) on the body 100, or by forming an insulating material on the body 100 through a vapor deposition process. When an insulating film is used, an Ajinomoto Build-up Film (ABF) which does not include a photosensitive insulating resin, or a polyimide film may be used.

The insulating layer 700 may have a thickness of 10 nm to 100 μm. When a thickness of the insulating layer 700 is lower than 10 nm, properties of a coil component such as a Q factor may reduce, and when a thickness of the insulating layer 700 is greater than 100 μm, an overall length, width, and thickness of the coil component may increase such that it may be difficult to reduce a size of the coil component. In one embodiment, the thickness of the insulating layer 700 is 50 nm, 100 nm, 500 nm, 1 μm, or 50 μm.

The cover layer 900 may be disposed on the shielding layer 800 to cover the shielding layer 800 and may be in contact with the insulating layer 700. In other words, the cover layer 900 may bury the shielding layer 800 in the cover layer 900 along with the insulating layer 700. Thus, the cover layer 900 may be disposed on the first to fifth surfaces 101, 102, 103, 104, and 105 of the body 100, similarly to the insulating layer 700. The cover layer 900 may cover ends of the side wall portions 821, 822, 823, and 824 such that the cover layer 700 may prevent electrical shorts between the side wall portions 821, 822, 823, and 824 and the first and second external electrodes 300 and 400. Further, the cover layer 900 may prevent the shielding layer 800 from being electrically connected to external electronic components.

The cover layer 900 may include at least one of a thermoplastic resin such as a polystyrene resin, a vinyl acetate resin, a polyester resin, a polyethylene resin, a polypropylene resin, a polyamide resin, a rubber resin, an acrylic resin, and the like, a thermosetting resin such as a phenolic resin, an epoxy resin, a urethane resin, a melamine resin, an alkyd resin, and the like, a photosensitive resin, a parylene, and silicon oxide (SiOx) or silicon oxide (SiNx).

The cover layer 900 may be formed by layering a cover film such as a dry film (DF) on the body 100 on which the shielding layer 800 is formed. Alternatively, the cover layer 900 may be formed by forming an insulating material on the body 100 on which the shielding layer 800 is formed through a vapor deposition process such as a chemical vapor deposition (CVD) process, or the like.

The cover layer 900 may have a thickness of 10 nm to 100 μm. When a thickness of the cover layer 900 is lower than 10 nm, insulating properties may be weakened such that electrical shorts may occur, and when a thickness of the cover layer 900 is greater than 100 μm, an overall length, width, and thickness of the coil component may increase, and it may be difficult to reduce a size of the coil component. In one embodiment, the thickness of the cover layer 900 is 50 nm, 100 nm, 500 nm, 1 μm, or 50 μm.

A sum of thicknesses of the insulating layer 700, the shielding layer 800, and the cover layer 900 may be greater than 30 nm, and may be 100 μm or lower. When a sum of thicknesses of insulating layer 700, the shielding layer 800, and the cover layer 900 is less than 30 nm, the issues such as electrical shorts, reduction of properties of a coil component such as a Q factor, and the like, may occur, whereas, when a sum of thicknesses of insulating layer 700, the shielding layer 800, and the cover layer 900 is greater than 100 μm, an overall length, width, and thickness of the coil component may increase, and it may be difficult to reduce a size of the coil component. In one embodiment, the sum of the thickness of the insulating layer 700, the shielding layer 800, and the cover layer 900 is 50 nm, 100 nm, 500 nm, 1 μm, or 50 μm.

Although not illustrated, in the exemplary embodiment, the coil component may further include an insulating film formed along surfaces of the first and second lead-out portions 231 and 232, the first and second coil patterns 211 and 212, the internal insulating layer IL, and the auxiliary lead-out portions 241 and 242. The insulating film may insulate the first and second lead-out portions 231 and 232, the first and second coil patterns 211 and 212, and first and second the auxiliary lead-out portions 241 and 242 from the body 100, and may include a well-known insulating material such as parylene, and the like. A material included in the insulating film may not be limited to any particular material. The insulating film may be formed through a vapor deposition process, and the like, but an example of the insulating film is not limited thereto. The insulating film may be formed by layering the insulating film on both surfaces of the internal insulating layer IL.

The insulating layer 700 and the cover layer 900 may be directly disposed in the coil component, and may be distinct from a molding material molding the coil component and a printed circuit board during a process of mounting the coil component on the printed circuit board. For example, the insulating layer 700 and the cover layer 900 may not be directly in contact with a printed circuit board, differently from a molding material. Also, the insulating layer 700 and the cover layer 900 may not be supported by or fixed to a printed circuit board, differently from a molding material. Further, differently from a molding material surrounding a connection member such as a solder ball which connects a coil component to a printed circuit substrate, the insulating layer 700 and the cover layer 900 may not surround a connection member. As the insulating layer 700 is not a molding material formed by heating an epoxy molding compound, and the like, flowing the heated epoxy molding compound onto a printed circuit board, and performing a curing process, it may not be necessary to consider a void occurring during a process of forming a molding material, or warpage of a printed circuit board caused by a difference in coefficients of thermal expansion between a molding material and a printed circuit board.

The shielding layer 800 may be directly disposed in the coil component in the exemplary embodiment, and thus, the shielding layer 800 may be different from a shielding can, which is coupled to a printed circuit board to shield EMI, and the like, after mounting the coil component on a printed circuit board. For example, the shielding layer 800 may not require a fixing member for fixing the shielding layer 800 to a printed circuit board, and may not be direction in contact with a printed circuit board, differently from a general shielding can.

Accordingly, the coil component 1000 according to the exemplary embodiment may effectively shield magnetic flux leakage occurring in the coil component by directly forming the shielding layer 800 in the coil component. In other words, as electronic devices have been reduced in size and have higher performances, the number of electronic components included in an electronic device and a distance between adjacent electronic components have been recently reduced. In the exemplary embodiment, each coil component may be shielded such that magnetic flux leakage occurring in coil components may be shielded effectively, thereby reducing sizes of electronic components and implementing high performance. Further, in the coil component 1000 in the exemplary embodiment, the amount of an effective magnetic material may be increased in a shielding region as compared to a configuration in which a shielding can is used, thereby improving properties of the coil component.

Also, in the coil component 1000 in the exemplary embodiment, an electrode structure may easily be implemented on a lower portion while reducing a size of the coil component. In other words, differently from the related art, the external electrodes may not be disposed on and protrude from the both front and rear surfaces 101 and 102 or both side surfaces 103 and 104 of the body 100, and thus, when the insulating layer 700, the shielding layer 800, and the cover layer 900 are formed, a size of the coil component 1000 may not be significantly increased. Also, as the external electrodes 300, 400, and 500 have relatively reduced thicknesses, an overall thickness of the coil component 100 may be reduced.

Also, in the coil component 1000 in the exemplary embodiment, as the first and second via electrodes 610 and 620 include the first and second extended portions 612 and 622, respectively, reliability may improve. In other words, the first and second extended portions 612 and 622 may respectively extend into the first and second lead-out portions 231 and 232, and thus, cohesion force between the coil portion 200 and the first and second via electrodes 610 and 620 may improve by female coupling. Accordingly, even when stresses occur in the coil component 1000, reliability may be maintained.

Second Embodiment

Figure 7:
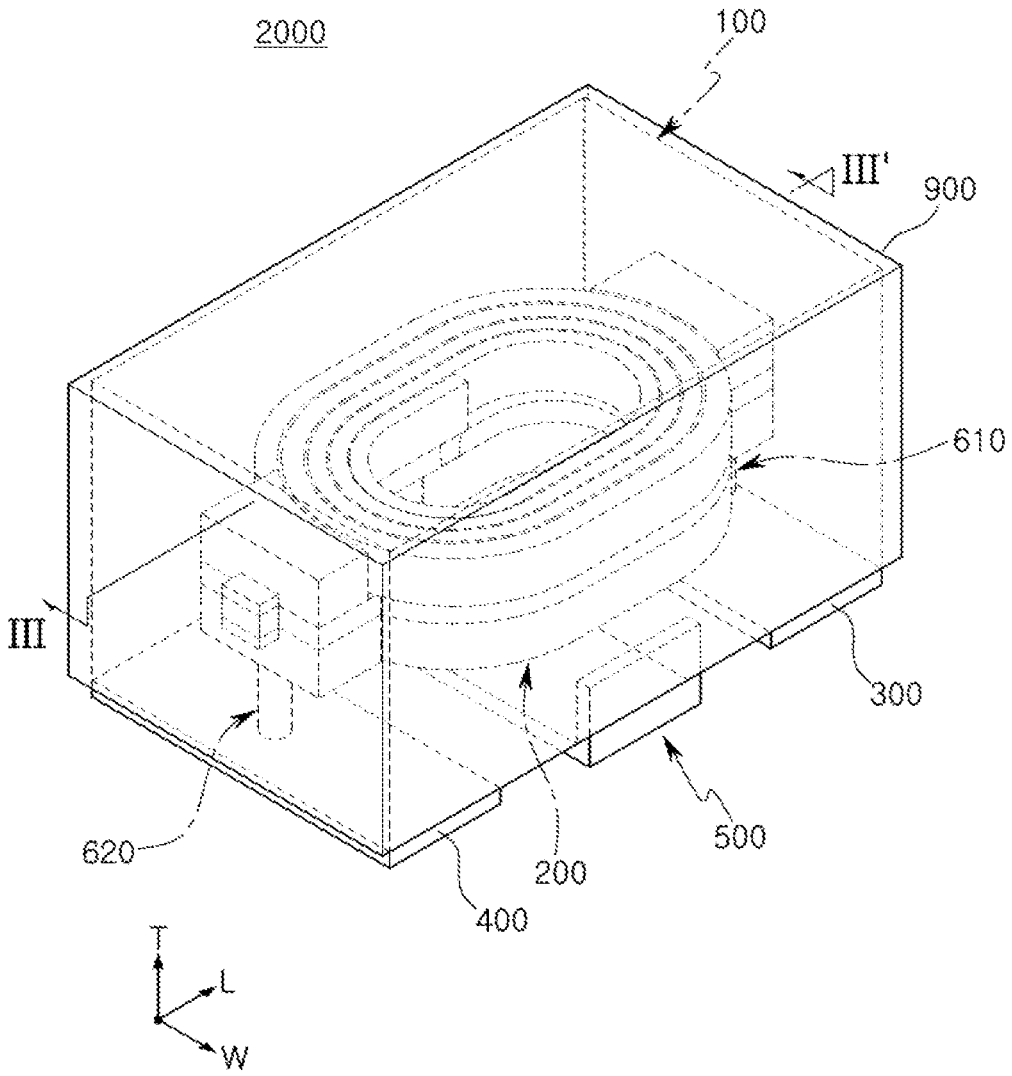
FIG. 7 is a schematic diagram illustrating a coil component according to another exemplary embodiment in the present disclosure.
Figure 8:
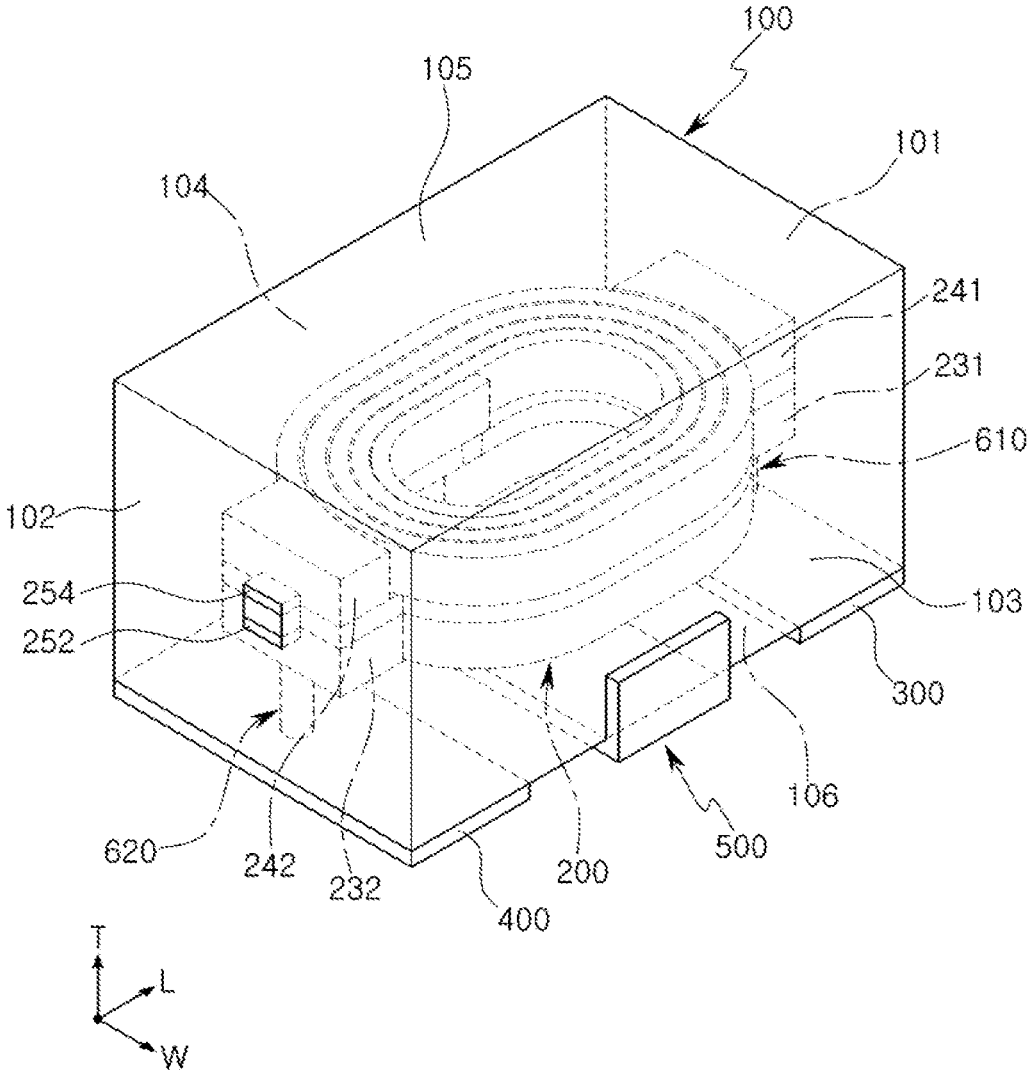
FIG. 8 is a coil component in which some of elements illustrated in FIG. 7 are omitted.
Figure 9:
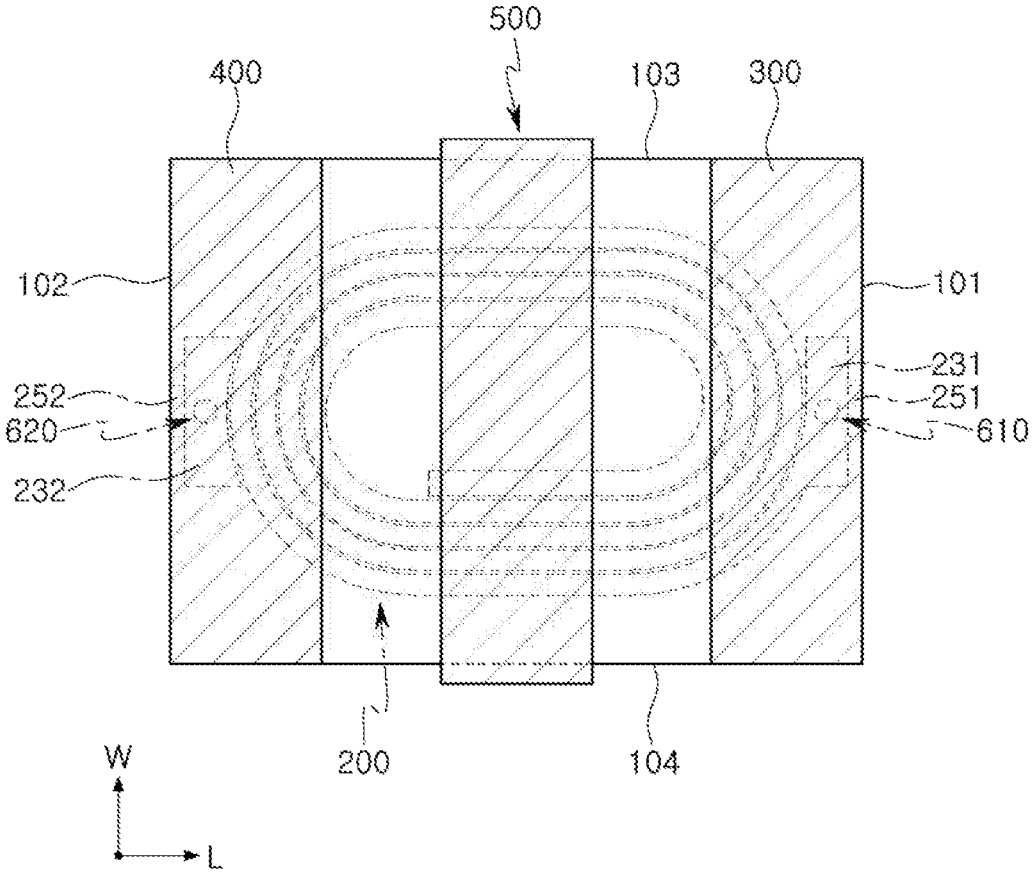
FIG. 9 is a diagram illustrating a coil component illustrated in FIG. 8, viewing from a lower portion direction.
Figure 10:
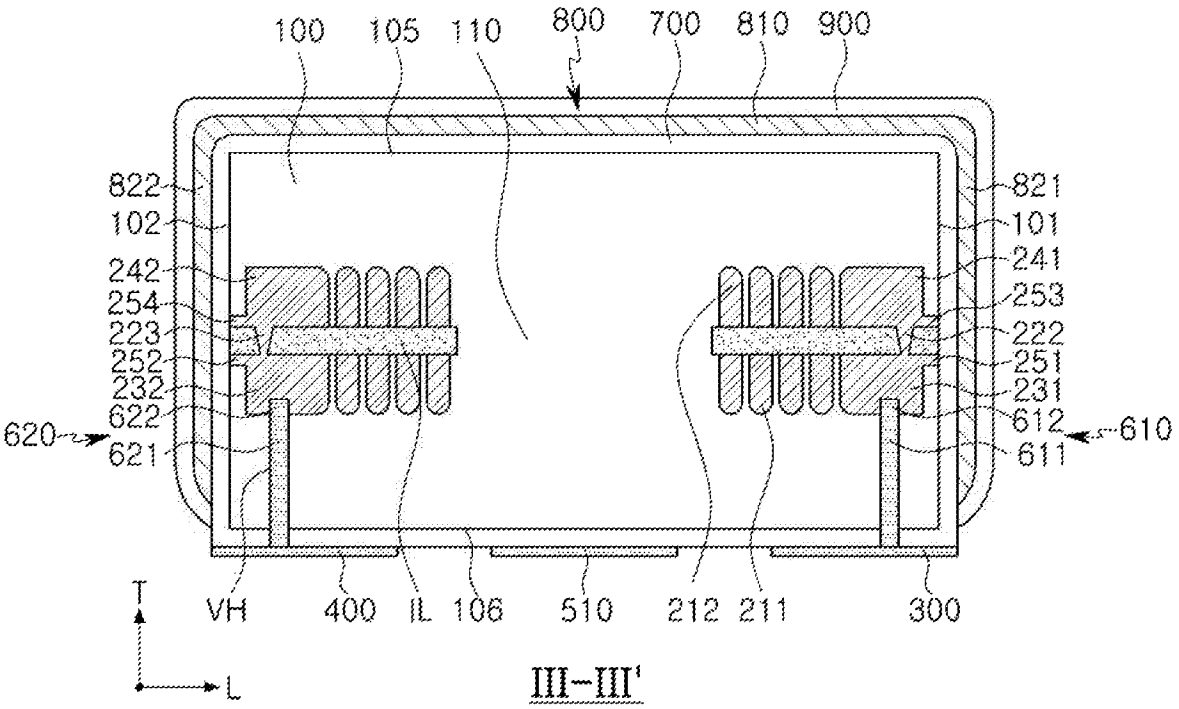
FIG. 10 is a cross-sectional diagram taken along line III-III' in FIG. 7.

FIG. 7 is a schematic diagram illustrating a coil component according to another exemplary embodiment. FIG. 8 is a coil component in which some of elements illustrated in FIG. 7 are omitted. FIG. 9 is a diagram illustrating a coil component illustrated in FIG. 8, viewing from a lower portion direction. FIG. 10 is a cross-sectional diagram taken along line in FIG. 7. With regard to FIG. 8, FIG. 8 illustrates a coil component illustrated in FIG. 7, where a shielding layer and a cover layer are omitted.

Referring to FIGS. 1 to 10, in a coil component 2000 according to the exemplary embodiment, a coil portion 200 may be different from the coil portion in the coil component 1000 in the aforementioned exemplary embodiment. Thus, in the exemplary embodiment, only the coil portion 200 will be described, which is different from the coil portion in the aforementioned exemplary embodiment. The descriptions of the other elements in the exemplary embodiment will be the same as the descriptions in the aforementioned exemplary embodiment.

The coil portion 200 in the exemplary embodiment may further include first to fourth cohesion reinforcing portions 251, 252, 253, and 254 respectively extending from first and second lead-out portions 231 and 232 and first and second auxiliary lead-out portions 241 and 242 and exposed to first and second surfaces 101 and 102 of the body 100. For example, the coil portion 200 may further include the first cohesion reinforcing portion 251 extending from the first lead-out portion 231 and exposed to the first surface 101 of the body 100, the second cohesion reinforcing portion 252 extending from the second lead-out portion 232 and exposed to the second surface 102 of the body 100, the third cohesion reinforcing portion 253 extending from the first auxiliary lead-out portion 241 and exposed to the first surface 101 of the body 100, and the fourth cohesion reinforcing portion 254 extending from the second auxiliary lead-out portion 242 and exposed to the second surface 102 of the body 100. In the exemplary embodiment, differently from the aforementioned exemplary embodiment, the first and second lead-out portions 231 and 232 and the first and second auxiliary lead-out portions 241 and 242 may not be exposed to the first and second surfaces 101 and 102 of the body 100, but the first to fourth cohesion reinforcing portions 251, 252, 253, and 254 extending from the first and second lead-out portions 231 and 232 and the first and second auxiliary lead-out portions 241 and 242 to both front and rear surfaces 101 and 102 of the body 100 may be exposed to the both front and rear surfaces 101 and 102 of the body 100.

The first to fourth cohesion reinforcing portions 251, 252, 253, and 254 may have widths smaller than widths of the first and second lead-out portions 231 and 232 and the first and second auxiliary lead-out portions 241 and 242, or may have thicknesses smaller than thicknesses of the first and second lead-out portions 231 and 232 and the first and second auxiliary lead-out portions 241 and 242. In other words, the first to fourth cohesion reinforcing portions 251, 252, 253, and 254 may reduce volumes of ends of the coil portion 200 such that areas of the coil portion 200 exposed to the first and second surfaces 101 and 102 of the body 100 may be significantly reduced.

Accordingly, in the coil component 2000 in the exemplary embodiment, cohesion force between the ends of the coil portion 200 and the body 100 may improve. In other words, by reducing volumes of regions of the coil portion 200 disposed externally of the body 100, cohesion force between the coil portion 200 and the body 100 may improve.

Further, in the coil component 2000 in the exemplary embodiment, by improving an effective volume of a magnetic material, degradation of component properties may be prevented.

Also, in the coil component 2000 in the exemplary embodiment, by reducing areas of the coil portion 200 exposed to both front and rear surfaces 101 and 102 of the body 100, electrical shorts may be prevented.

In the exemplary embodiment, a plurality of the first to fourth cohesion reinforcing portions 251, 252, 253, and 254 may be provided in the first and second lead-out portions 231 and 232 and the first and second auxiliary lead-out portions 241 and 242. For example, at least one of the first cohesion reinforcing portion 251, the second cohesion reinforcing portion 252, the third cohesion reinforcing portion 253, and the fourth cohesion reinforcing portion 254 may be provided as a plurality of cohesion reinforcing portions. In this case, a contact area between the coil portion 200 and the body 100 may increase such that cohesion force therebetween may be improved.

Third Embodiment

Figure 11:
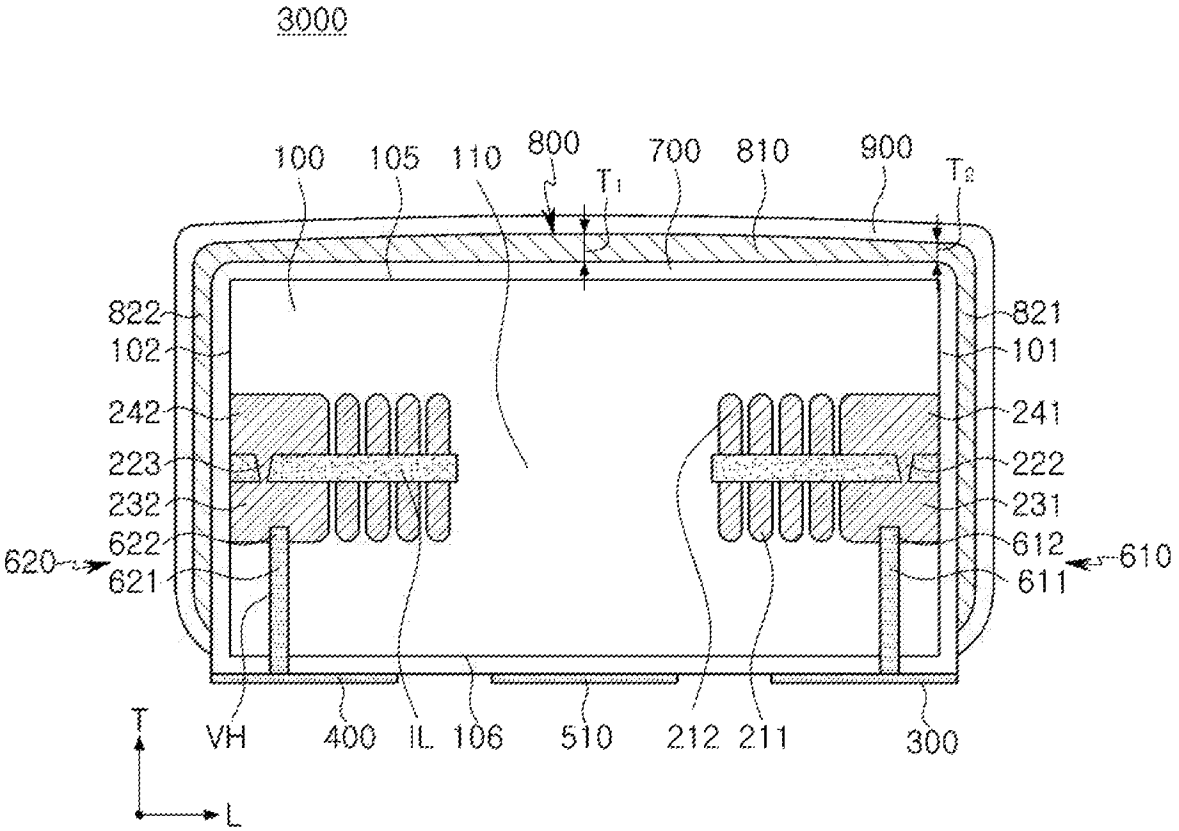
FIG. 11 is a cross-sectional diagram illustrating a coil component according to another exemplary embodiment in the present disclosure, corresponding to a cross-section taken along line I-I' in FIG. 1.

FIG. 11 is a cross-sectional diagram illustrating a coil component according to another exemplary embodiment. FIG. 11 corresponds to a cross-section taken along line I-I' in FIG. 1.

Referring to FIGS. 1 to 11, in a coil component 3000 according to an exemplary embodiment, a cap portion 810 may different from the cap portions in the coil components 1000 and 2000 in the aforementioned exemplary embodiments. Thus, in the exemplary embodiment, only the cap portion 810 will be described, which is different from the cap portions in the aforementioned exemplary embodiments. The descriptions of the other elements in the exemplary embodiment will be the same as the descriptions in the aforementioned exemplary embodiments.

Referring to FIG. 11, the cap portion 810 may have a thickness configured such that a thickness $T_1$ of a central portion of the cap portion 810 is greater than a thickness $T_2$ of an outer portion of the cap portion 810.

First and second Coil patterns 211 and 212 of a coil portion 200 may form a plurality of turns towards an outer portion of an internal insulating layer IL from a central portion of the internal insulating layer IL on both surfaces of the internal insulating layer IL, and the first and second coil patterns 211 and 212 may be layered in a thickness direction T of the body 100 and connected to a via 221. Accordingly, in the coil component 3000 in the exemplary embodiment, magnetic flux density may be the highest at a central portion of a plane taken in a length direction L and a width direction W of the body 100 perpendicular to a thickness direction T of the body 100. Thus, when the cap portion 810 disposed on a fifth surface of the body 100 substantially parallel to the plane taken in a length direction L and a width direction W of the body 100 is formed, the cap portion 810 may be configured such that the thickness $T_1$ of the central portion of the cap portion 810 may be greater than the thickness $T_2$ of the outer portion in consideration of magnetic flux density distribution at the plane taken in a length direction L and a width direction W of the body 100.

Accordingly, in the coil component 3000 in the exemplary embodiment, by configuring thicknesses of the portions of the cap portion 810 differently in consideration of magnetic flux density distribution, magnetic flux leakage may be reduced effectively.

Fourth Embodiment

Figure 12:
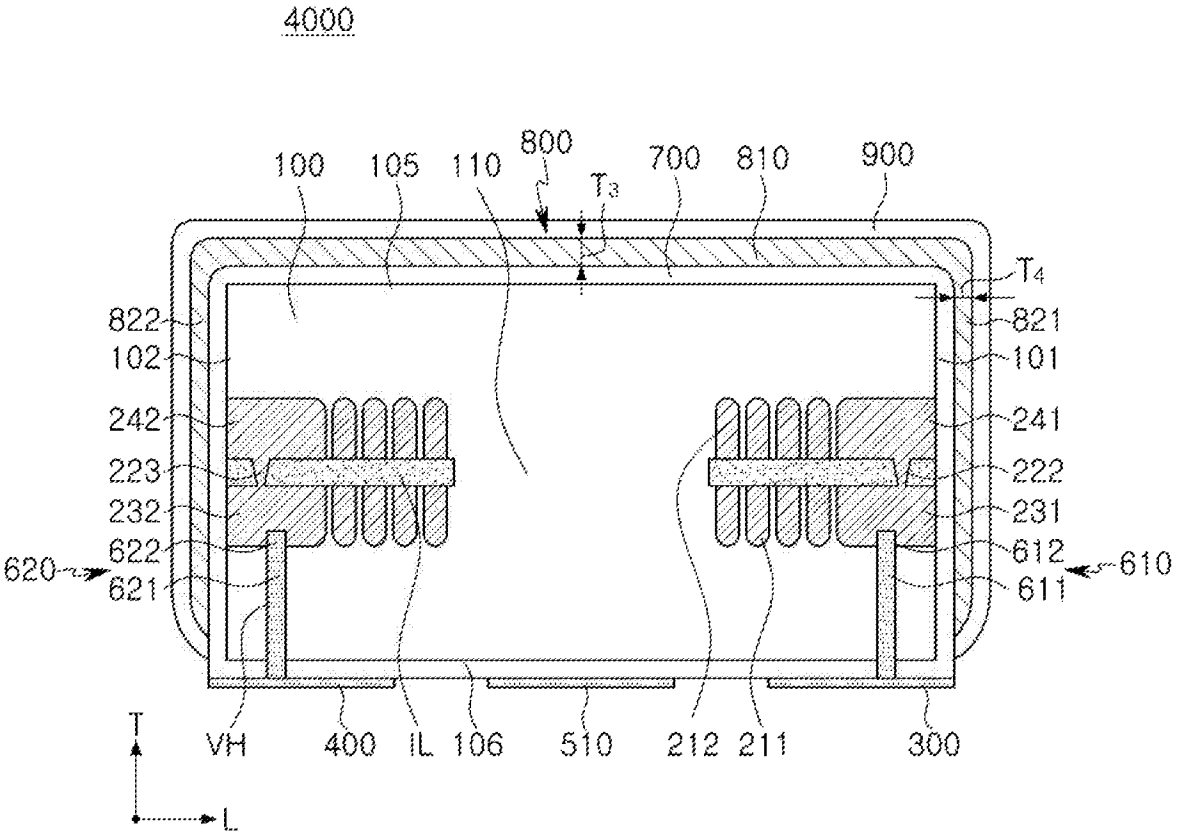
FIG. 12 is a cross-sectional diagram illustrating a coil component according to another exemplary embodiment in the present disclosure, corresponding to a cross-section taken along line I-I' in FIG. 1.

FIG. 12 is a cross-sectional diagram illustrating a coil component according to another exemplary embodiment. FIG. 12 corresponds to a cross-section taken along line I-I' in FIG. 1.

Referring to FIGS. 1 to 12, in a coil component 4000 according to the exemplary embodiment, a cap portion 810 and side wall portions 821, 822, 823, and 824 may be different from the cap portion and the side wall portions in the coil components 1000, 2000, and 3000 in the aforementioned exemplary embodiments. Thus, in the exemplary embodiment, only the cap portion 810 and the side wall portions 821, 822, 823, and 824 will be described, which are different from the cap portion and the side wall portions in the aforementioned exemplary embodiments. The descriptions of the other elements in the exemplary embodiment will be the same as the descriptions in the aforementioned exemplary embodiments.

Referring to FIG. 12, the cap portion 810 may have a thickness $T_3$ greater than thicknesses of the side wall portions 821, 822, 823, and 824.

As described above, the coil portion 200 may generate magnetic fields in a thickness direction T of the body 100. Accordingly, magnetic flux leaking in a thickness direction T of the body 100 may be greater than a magnetic flux leaking in the other directions. Thus, a thickness of the cap portion 810 disposed on the fifth surface of the body 100, which is perpendicular to the thickness direction T of the body 100, may be configured to be greater than thicknesses of the side wall portions 821, 822, 823, and 824 disposed on walls of the body 100, thereby reducing magnetic flux leakage effectively.

As an example, the body 100 may be disposed such that the fifth surface 105 of the body 100 opposes a target, and a sputtering process for forming a shielding layer 800 may be performed, thereby configuring a thickness of the cap portion 810 to be greater than thicknesses of the side wall portions 821, 822, 823, and 824. However, an exemplary embodiment thereof is not limited thereto.

Accordingly, in the coil component 4000 in the exemplary embodiment, magnetic flux leakage may be reduced effectively in consideration of a direction of a magnetic field formed by the coil portion 200.

According to the aforementioned exemplary embodiments, magnetic flux leakage of the coil component may be reduced.

Further, a size and a thickness of the coil component may be reduced while reducing magnetic flux leakage.

While the exemplary embodiments have been shown and described above, it will be apparent to those skilled in the art that modifications and variations could be made without departing from the scope of the present invention as defined by the appended claims.

What is claimed is:

1. A coil component, comprising:

a body having a bottom surface and a top surface opposing each other in one direction, and a plurality of walls each connecting the bottom surface to the top surface of the body;

a coil portion buried in the body, and having first and second lead-out portions;

first and second external electrodes disposed on bottom surface of the body and spaced apart from each other;

one or more via electrodes penetrating through the body and connecting the first and second lead-out portions and the first and second external electrodes to each other;

a third external electrode including a pad portion disposed on the bottom surface of the body, and a connection portion extending to portions of the plurality of walls of the body, and spaced apart from the first and second external electrodes;

a shielding layer disposed on the top surface and side wall portions of the body, and connected to the third external electrode, wherein the shielding layer includes a cap portion disposed on the shielding layer; and an insulating layer disposed between the shielding layer and the body, and between the first to third external electrodes and the body, wherein the one or more via electrodes include through-portions formed in the body, and extended portions respectively extending into the first and second lead-out portions from the through-portions.

2. The coil component of claim 1, further comprising:

an internal insulating layer buried in the body to support the coil portion, wherein the first and second lead-out portions are disposed on one surface of the internal insulating layer opposing the bottom surface of the body, and are spaced apart from each other.

3. The coil component of claim 2, wherein the coil portion further comprises a first coil pattern disposed on one surface of the internal insulating layer being in contact with the first lead-out portion and spaced apart from the second lead-out portion, a second coil pattern disposed on the other surface of the internal insulating layer opposing the one surface of the internal insulating layer, and one or more via penetrating through the internal insulating layer to connect the first coil pattern and the second coil pattern.

4. The coil component of claim 3, wherein the coil portion further comprises one or more auxiliary lead-out portions disposed on the other surface of the internal insulating layer and being in contact with the second coil pattern, and connected to the second lead-out portion.

5. The coil component of claim 4, wherein the first and second lead-out portions and the one or more auxiliary lead-out portions are exposed to both front and rear surfaces of the body opposing each other among the plurality of walls of the body.

6. The coil component of claim 4, wherein the coil portion further includes one or more cohesion reinforcing portions respectively extending from the first and second lead-out portions and the one or more auxiliary lead-out portions and exposed to both front and rear surfaces of the body opposing each other among the plurality of walls of the body.

7. The coil component of claim 6, wherein the cohesion reinforcing portions have thicknesses smaller than thicknesses of the first and second lead-out portions.

8. The coil component of claim 6, wherein the cohesion reinforcing portions have widths smaller than widths of the first and second lead-out portions.

9. The coil component of claim 1, wherein the cap portion has a thickness configured such that a thickness of the cap portion is greater at a central portion of the top surface of the body than at an outer portion of the top surface of the body.

10. The coil component of claim 1, wherein the cap portion has a thickness greater than thicknesses of the side wall portions.

11. The coil component of claim 1, wherein the shielding layer includes at least one of a conductive material and a magnetic material.

12. A coil component, comprising:

a body including an insulating resin and a magnetic metal powder dispersed in the insulating resin;

an internal insulating layer buried in the body;

a coil portion including lead-out portions disposed on one surface of the internal insulating layer opposing a lower surface of the body, and buried in the body;

first and second external electrodes disposed on a lower surface of the body and spaced apart from each other;

via electrodes penetrating through the body to connect the lead-out portions and the first and second external electrodes, and extending into the lead-out portions;

a shielding layer formed on the body, and including a pad portion extending to a lower surface of the body; and an insulating layer disposed between the body and the first and second external electrodes, and between the body and the shielding layer.

13. The coil component of claim 1, wherein the one or more via electrodes are a first via electrode and a second via electrode, and the first and second via electrodes penetrate through the body and connect the first and second external electrodes and the first and second lead-out portions respectively.

14. The coil component of claim 6, wherein the one or more cohesion reinforcing portions are first, second, third and fourth cohesion reinforcing portions, wherein:

the first and second cohesion reinforcing portions respectively extend from the first and second lead-out portions and are exposed to front and rear surfaces of the body, respectively; and third and fourth cohesion reinforcing portions extend from the first and second auxiliary lead-out portions and are exposed to front and rear surfaces of the body, respectively.

* * * * *